US006622482B2

(12) United States Patent
Knight et al.

(10) Patent No.: US 6,622,482 B2
(45) Date of Patent: Sep. 23, 2003

(54) COMBINED CATALYTIC MUFFLER

(75) Inventors: Glenn Knight, Pouch Cove (CA); Nils Rodeblad, St. John's (CA)

(73) Assignee: Environmental Control Corporation, St. John's (CA)

( * ) Notice: Subject to any disclaimer, the term of this patent is extended or adjusted under 35 U.S.C. 154(b) by 0 days.

(21) Appl. No.: 09/891,328

(22) Filed: Jun. 27, 2001

(65) Prior Publication Data

US 2003/0000208 A1 Jan. 2, 2003

(51) Int. Cl.[7] ..... F01N 3/10

(52) U.S. Cl. ..... 60/299; 60/302; 181/258; 181/264

(58) Field of Search ..... 60/299; 302/3, 302/310, 311; 181/230, 258, 265, 266, 229, 264

(56) References Cited

U.S. PATENT DOCUMENTS

| | | | | |
|---|---|---|---|---|
| 1,891,170 A | * | 12/1932 | Nose | 60/310 |
| 3,577,728 A | | 5/1971 | Brimer et al. | 60/30 |
| 3,613,359 A | | 10/1971 | Posh et al. | 60/30 |
| 3,712,065 A | | 1/1973 | Hurst | 60/274 |
| 3,729,936 A | | 5/1973 | De Palma et al. | 60/274 |
| 3,823,555 A | | 7/1974 | Cole | 60/274 |
| 3,857,458 A | | 12/1974 | Ohtani et al. | 181/43 |
| 3,910,770 A | | 10/1975 | Kobylinski et al. | 23/288 |
| 3,918,918 A | | 11/1975 | Kohn et al. | 23/288 |
| 3,929,420 A | | 12/1975 | Wood | 23/288 |
| 3,948,810 A | | 4/1976 | Hervert | 252/477 R |
| 3,957,445 A | | 5/1976 | Foster | 23/288 |
| 3,982,396 A | | 9/1976 | Suzuki | 60/282 |
| 4,008,570 A | | 2/1977 | Harada | 60/229 |
| 4,048,092 A | | 9/1977 | Davies et al. | 252/412 |
| 4,056,934 A | * | 11/1977 | Mizusawa et al. | 60/311 |
| 4,094,645 A | | 6/1978 | Bailey | 23/288 |
| 4,197,704 A | | 4/1980 | Date et al. | 60/322 |
| 4,206,177 A | | 6/1980 | Otsubo et al. | 422/171 |
| 4,209,493 A | | 6/1980 | Olson | 422/176 |
| 4,231,221 A | | 11/1980 | Mathner et al. | 60/319 |
| 4,233,812 A | * | 11/1980 | Leistritz | 181/265 |
| 4,321,240 A | | 3/1982 | Robinson | 423/210 |
| 4,393,652 A | | 7/1983 | Munro | 60/295 |
| 4,420,933 A | | 12/1983 | Kajitani et al. | 60/302 |
| 4,541,240 A | | 9/1985 | Munro | 60/295 |
| 4,559,776 A | | 12/1985 | Arai et al. | 60/280 |
| 4,601,168 A | | 7/1986 | Harris | 60/299 |
| 4,628,689 A | * | 12/1986 | Jourdan | 60/299 |
| 4,797,263 A | | 1/1989 | Oza | 422/176 |
| 4,894,987 A | | 1/1990 | Harwood et al. | 60/299 |
| 4,916,897 A | | 4/1990 | Hayashi et al. | 60/286 |
| 5,016,438 A | | 5/1991 | Harris | 60/299 |
| 5,043,147 A | | 8/1991 | Knight | 422/180 |
| 5,062,263 A | | 11/1991 | Carboni | 60/299 |
| 5,103,641 A | | 4/1992 | Maus et al. | 60/299 |
| 5,134,849 A | | 8/1992 | McWhorter | 60/304 |
| 5,138,834 A | | 8/1992 | Maund et al. | 60/276 |
| 5,150,573 A | | 9/1992 | Maus et al. | 60/299 |
| 5,185,998 A | | 2/1993 | Brew | 60/299 |
| 5,220,789 A | | 6/1993 | Riley et al. | 60/302 |

(List continued on next page.)

FOREIGN PATENT DOCUMENTS

| | | | |
|---|---|---|---|
| EP | 0 484 925 A1 | 11/1991 | F01N/3/28 |
| EP | 1 050 670 A2 | 5/1997 | F01N/3/28 |

*Primary Examiner*—Thomas Denion
*Assistant Examiner*—Tu M. Nguyen
(74) *Attorney, Agent, or Firm*—Gowling Lafleur Henderson LLP

(57) ABSTRACT

A catalytic muffler has at least one reactor bed, each bed having an array of discreet adjacent flow zones. The flow zones are interconnected by a series of passages for unidirection flow of a gaseous fluid sequentially through each adjacent zone in turn from an inlet side of each reactor bed to an outlet side of the reactor bed. An inlet fluidly communicates with a first of the flow zones. An outlet fluidly communicates with the last of the flow zones.

17 Claims, 8 Drawing Sheets

U.S. PATENT DOCUMENTS

| | | | | | |
|---|---|---|---|---|---|
| 5,285,640 | A | | 2/1994 | Olivo | 60/274 |
| 5,431,013 | A | | 7/1995 | Yamaki et al. | 60/289 |
| 5,468,923 | A | * | 11/1995 | Kleyn | 60/299 |
| 5,521,339 | A | * | 5/1996 | Despain et al. | 181/265 |
| 5,548,955 | A | | 8/1996 | Sandefur et al. | 60/299 |
| 5,732,555 | A | | 3/1998 | Gracyalny et al. | 60/299 |
| 6,109,026 | A | * | 8/2000 | Karlsson et al. | 60/299 |
| 6,199,657 | B1 | * | 3/2001 | Misawa et al. | 181/229 |
| 6,212,882 | B1 | * | 4/2001 | Greger et al. | 60/274 |

* cited by examiner

COMBINED CATALYTIC MUFFLER

FIELD OF THE INVENTION

This invention relates generally to engine exhaust handling apparatus, and more particularly, to apparatus for noise abatement and catalytic treatment of internal combustion engine exhaust gasses.

BACKGROUND OF THE INVENTION

In the burning of petroleum fuels in an internal combustion engine, hydrocarbons in the fuel and nitrogen and oxygen from the air used to combust the fuel combine to yield various oxides and nitrides, principally comprising carbon monoxide, carbon dioxide, nitrous oxide and nitric oxide. Waste materials in the fuel, such as sulphur produce other oxides such as sulphur dioxide. Additionally, some of the fuel passes into the exhaust partially combusted or uncombusted.

Some oxides are more harmful to human beings than other oxides. For example carbon dioxide may pose less of a hazard than carbon monoxide. In order to minimize the more harmful emissions, most larger internal combustion engines, particularly those used in automobiles are equipped with exhaust gas catalysts in their exhaust systems ("catalytic converters") to convert less desirable oxides to more desirable oxides.

Automobiles generally have a fair amount of space available for both a catalytic converter and for noise abatement apparatus such as mufflers and resonators to suppress the noise ordinally associated with internal combustion engine operation.

Smaller engines in applications such as lawnmowers are significant generators of pollutants but in the past have seldom if ever been equipped with exhaust treatment apparatus, despite that for their size they often generate proportionately more harmful emissions. Reasons for this may include the lack of expensive and sophisticated engine management systems found in more expensive applications such as automobiles.

It is an object of the present invention to provide an efficient catalytic muffler design which lends itself to compact dimensions so as to be easily accommodated in internal combustion engine applications.

It is a further object of the present invention to provide such a compact catalytic muffler which also has noise attenuation capabilities to obviate the need for a separate muffler.

It is also an object of the present invention to provide a noise abating catalytic muffler design for small engine applications which is simple and comparatively inexpensive to produce and which lends itself readily both to O.E.M. and retrofit applications.

SUMMARY OF THE INVENTION

A catalytic muffler having at least one reactor bed, each bed having an array of discreet adjacent flow zones, the flow zones being interconnected by a series of passages for unidirectional flow of a gaseous fluid sequentially through each adjacent zone in turn from an inlet side of each reactor bed to an outlet side of the reactor bed. An inlet fluidly communicates with a first of the flow zones. An outlet fluidly communicates with the last of the flow zones.

The catalytic muffler may include a housing having a partition dividing the housing into a reactor side and a return side. The reactor bed may be housed within the reactor side. The adjacent zones may be defined by wall members extending between the reactor bed, the housing and the partition at the inlet and outlet sides of the bed. The passages may be defined by baffle members in the return side of the housing, the baffle members extending between the partition and the housing. The passages may fluidly communicate with respective of the flow zones through respective apertures extending through the partition.

The catalytic muffler may have two reactor beds spaced apart with inlet sides facing. A single inlet may fluidly communicate with both of the first zones and a respective outlet may fluidly communicate with each of the last zones.

The catalytic muffler may have two reactor beds spaced apart with outlet sides facing. A respective inlet may fluidly communicate with each of the first zones and a single outlet may fluidly communicate with both of the last zones.

A first of the passages may diverge in the flow direction to reduce exhaust gas velocity as it flows therethrough and a last of the passages may converge to increase gas velocity as it flows therethrough.

A last of the apertures before the outlet may include an adjustable flow restrictor for varying flow restriction through the catalytic muffler.

The first passage may diverge by an amount corresponding to an amount by which the last passage converges.

The reactor bed may be made up of two parts, namely an upstream part and a downstream part. The upstream part may bear a reducing catalyst and the downstream part an oxidizing catalyst.

DESCRIPTION OF DRAWINGS

Preferred embodiments of the invention are described in detail below with reference to the accompanying figures in which.

DESCRIPTION OF THE PREFERRED EMBODIMENTS

Figure 1:
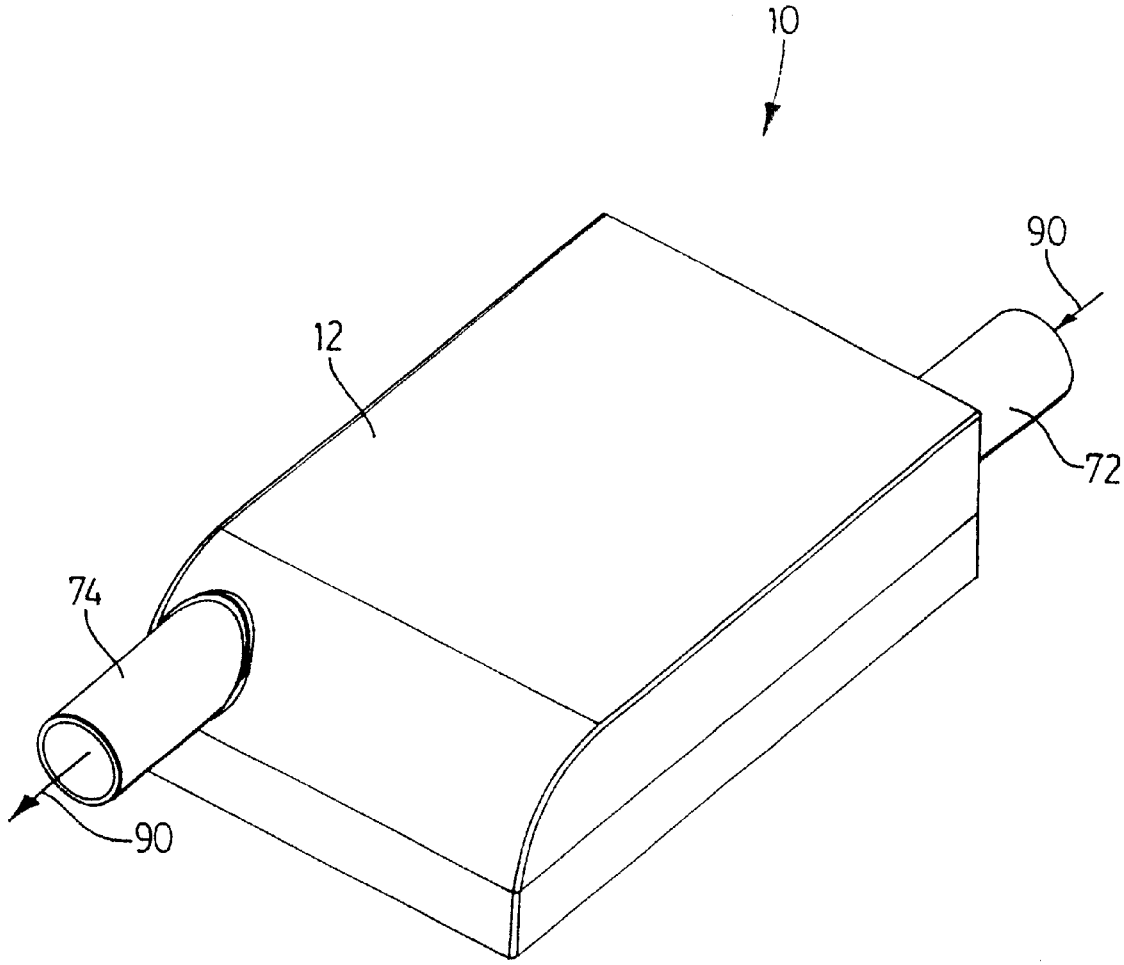
FIG. 1 is a perspective view from above of a catalytic muffler according to the present invention.
Figure 2:
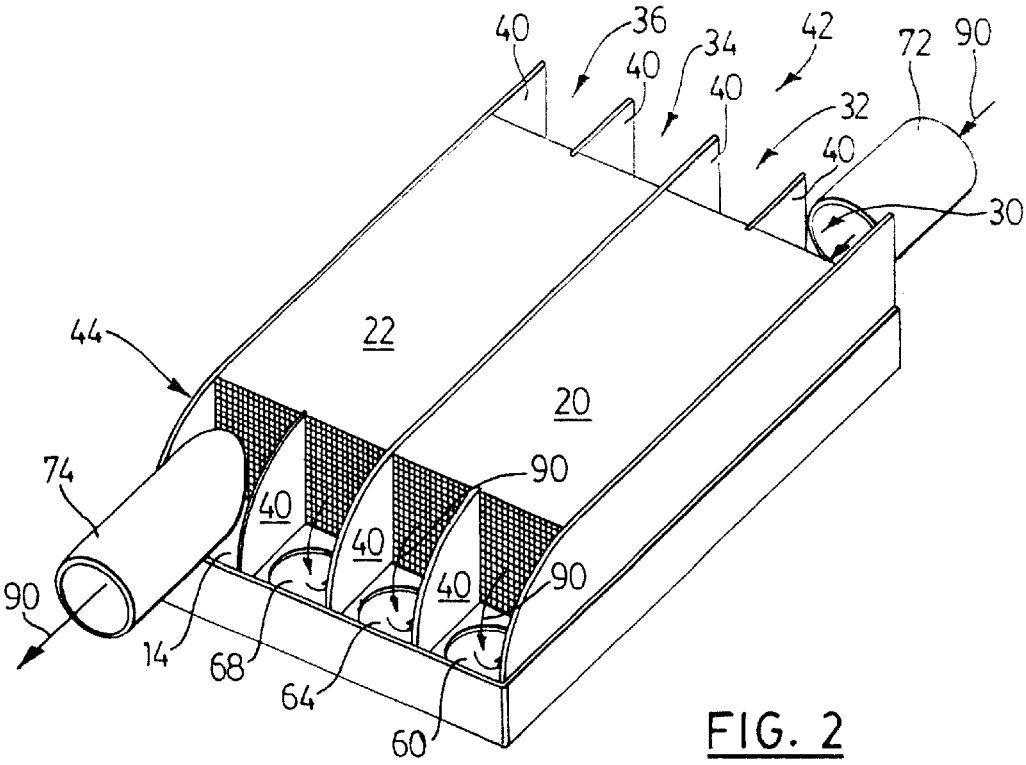
FIG. 2 is a perspective view of a reactor side of a catalytic muffler according to the present invention taken from its outlet side and with a top of its housing removed to show its interior configuration.
Figure 3:
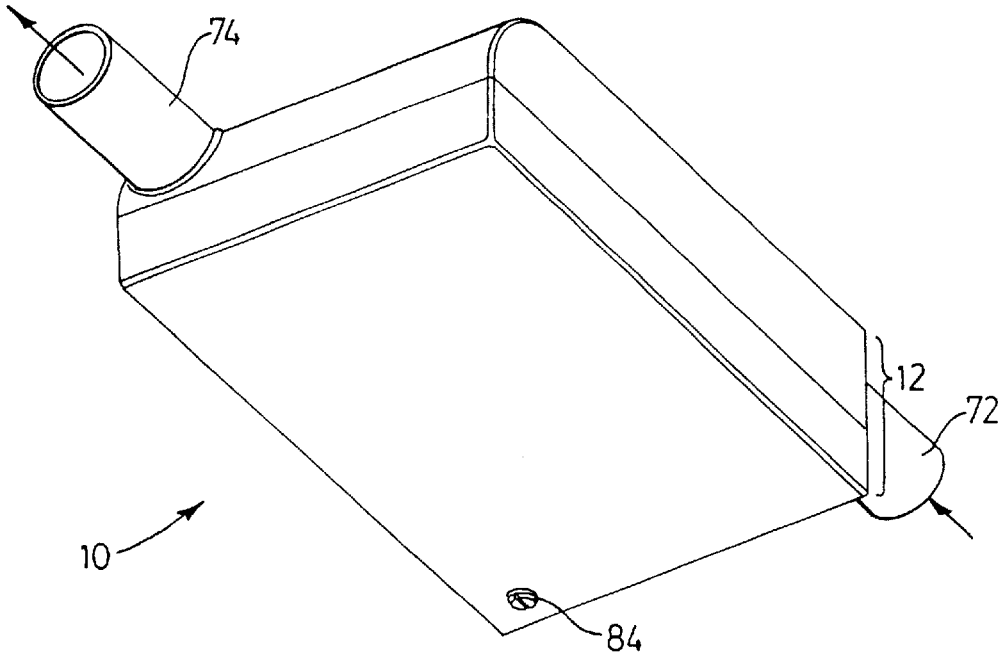
FIG. 3 is a bottom perspective view of a catalytic muffler according to the present invention.

A catalytic muffler according to the present invention is generally indicated by reference 10 in the accompanying drawings. The catalytic muffler 10 has a generally rectangular housing 12 having a partition 14 dividing the housing 12 into a reactor side 16 and a return side 18.

The reactor side 16 houses at least one reactor bed, however, in a more preferred embodiment it houses a reducing bed 20 and an oxidizing bed 22. The reactor beds 20 and 22 respectively may be a conventional honeycomb ceramic substrate having a plurality of discrete flow passages 24 extending longitudinally therethrough. A catalyst is typically borne by the substrate which, in the case of the oxidizing bed 22 promotes further oxidation of gases passing therethrough, and in the case of the reducing bed 20, provides reduction of gasses passing therethrough. Preferably he reducing bed 20 is located upstream of the oxidizing bed 22.

The oxidizing and reducing beds, 22 and 20 respectively, are divided into an array of discrete adjacent flow zones 30, 32, 34 and 36 by wall members 40 extending between the oxidizing and reducing beds 22 and 20 respectively, the housing 10 and the partition 12. The oxidizing and reducing beds 22 and 20 respectively, each have an inlet side 42 at one end thereof and an outlet side 44 at an opposite end thereof.

The return side of the catalytic muffler 10 is divided by baffle members 48 into a series of adjacent flow passages including an upstream passage 50, a downstream passage 52 and an intermediate passage 54. The upstream passage 50 fluidly communicates with the outlet side 44 of the flow zone 30 which may be considered as the "first" flow zone through an aperture 60. The upstream flow passage 50 also communicates with the inlet side 42 of the adjacent flow zone 32 through an aperture 62 extending through the partition 14. In a similar manner, the intermediate flow passage 54 provides fluid communication between the outlet side 44 of the flow zone 32 and the inlet side 42 of the adjacent flow zone 34 through respective apertures 64 and 66 extending through the partition 14. The downstream flow passage 52 provides fluid communication between the outlet side 44 of the flow zone 34 and the inlet side 42 of the flow zone 36 which may be considered the "last" flow zone through respective apertures 68 and 70 extending through the partition 14.

In other words, gas flow through the catalytic muffler is directed from an inlet 72 into the inlet side 42 of the first flow zone 30, sequentially through the adjacent flow zones 32, 34 and 36 to exit through an outlet 74 fluidly communicating with the outlet side 44 of the last flow zone 36, with gas flow through the reactor beds 20 and 22 being unidirectional, from the inlet side 42 to the outlet side 44.

Figure 4:
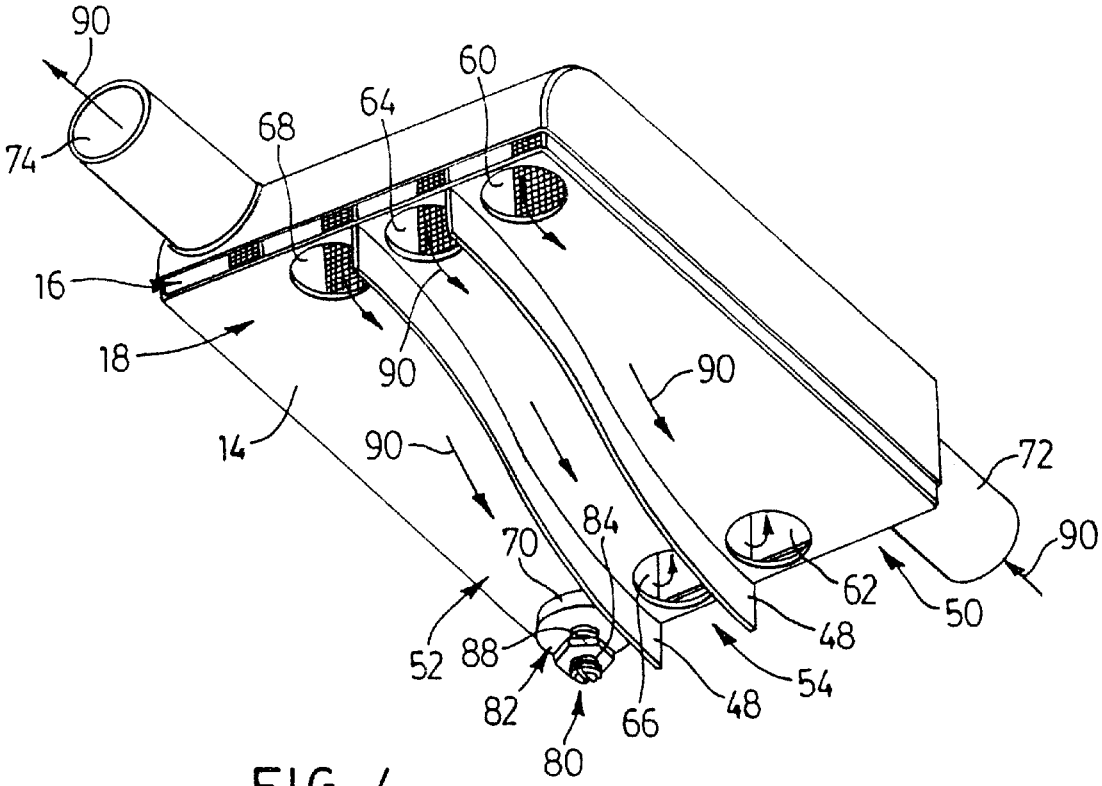
FIG. 4 is a perspective view of a return side of a return side of a catalytic muffler according to the present invention with a bottom part of its housing removed to show its interior configuration.
Figure 5:
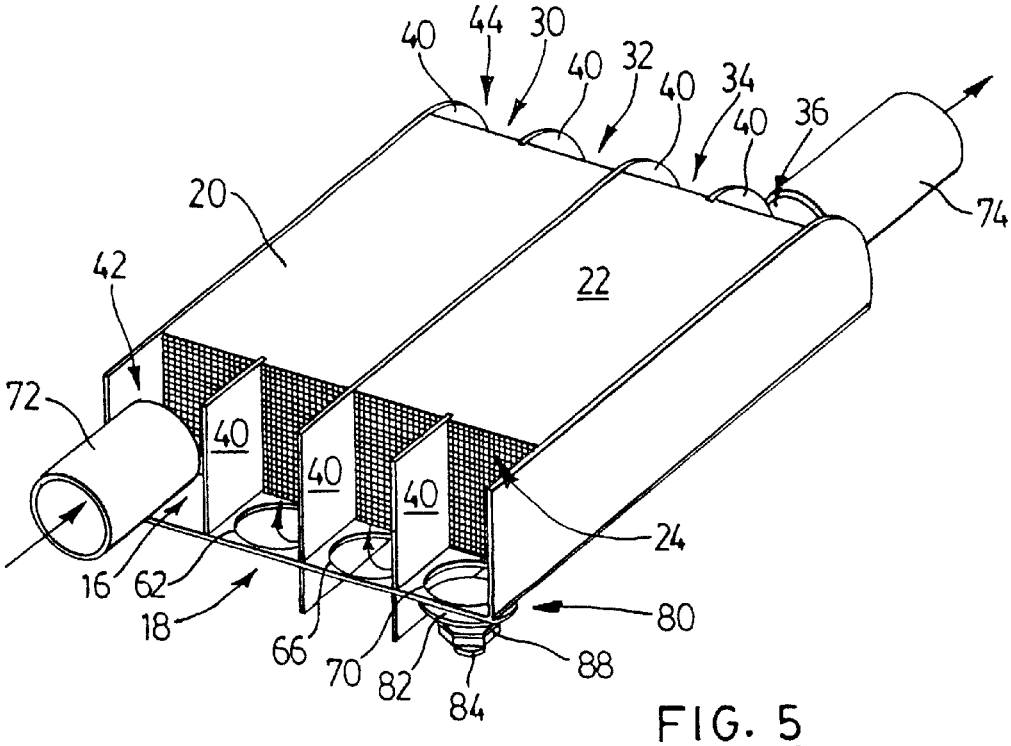
FIG. 5 is a view corresponding to FIG. 2 but taken from the opposite or inlet side.
Figure 6:
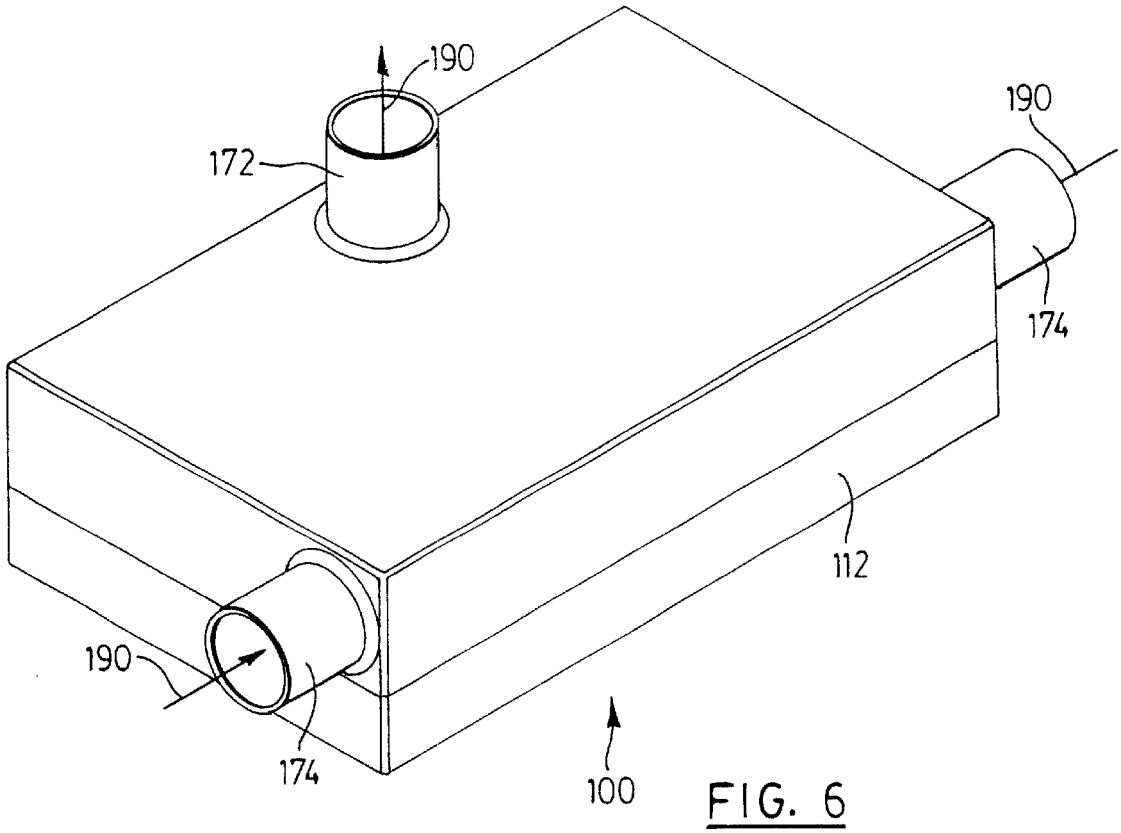
FIG. 6 is a perspective view from above of an alternate embodiment catalytic muffler according to the present invention.
Figure 7:
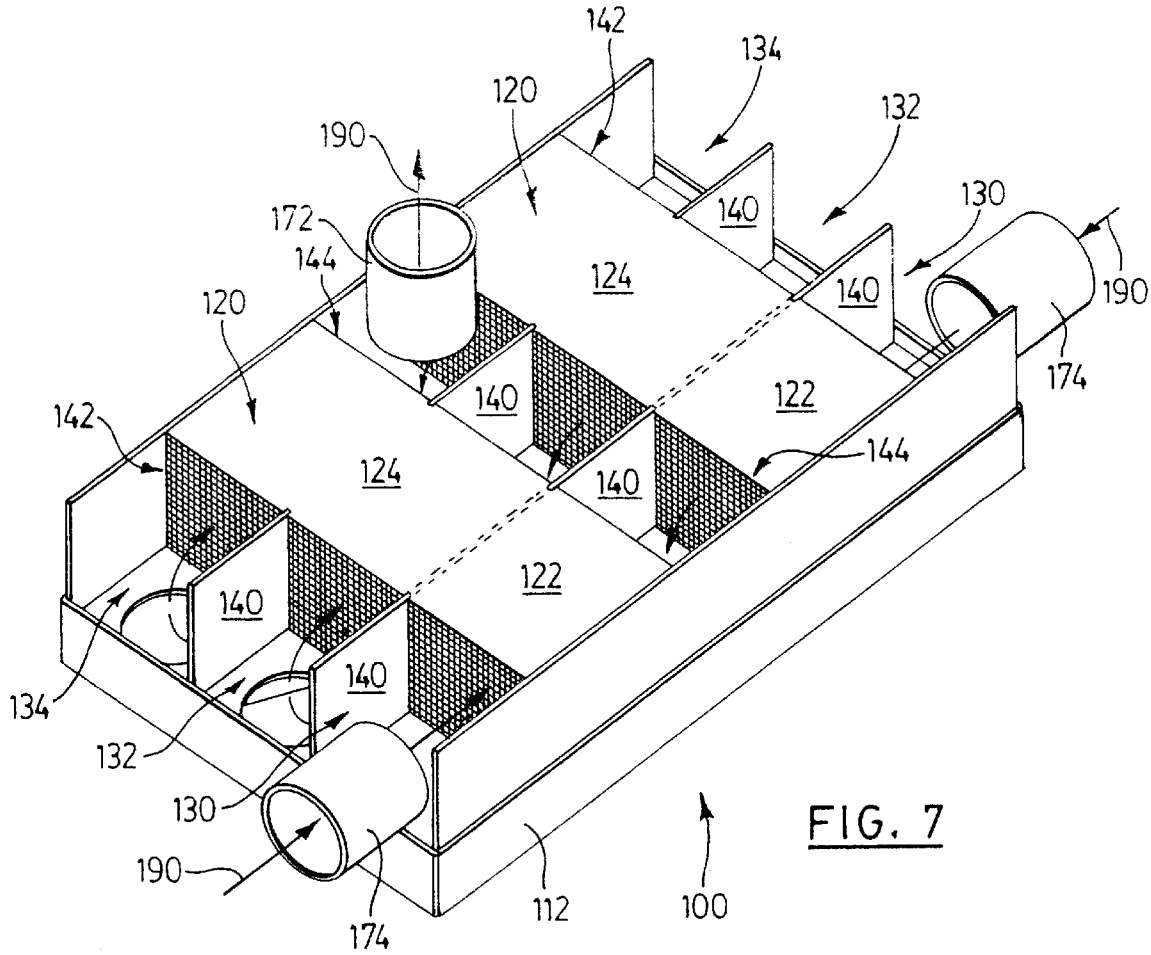
FIG. 7 is a perspective view of a reactor side of the catalytic muffler FIG. 6 with a top of the housing removed to show its interior configuration.
Figure 8:
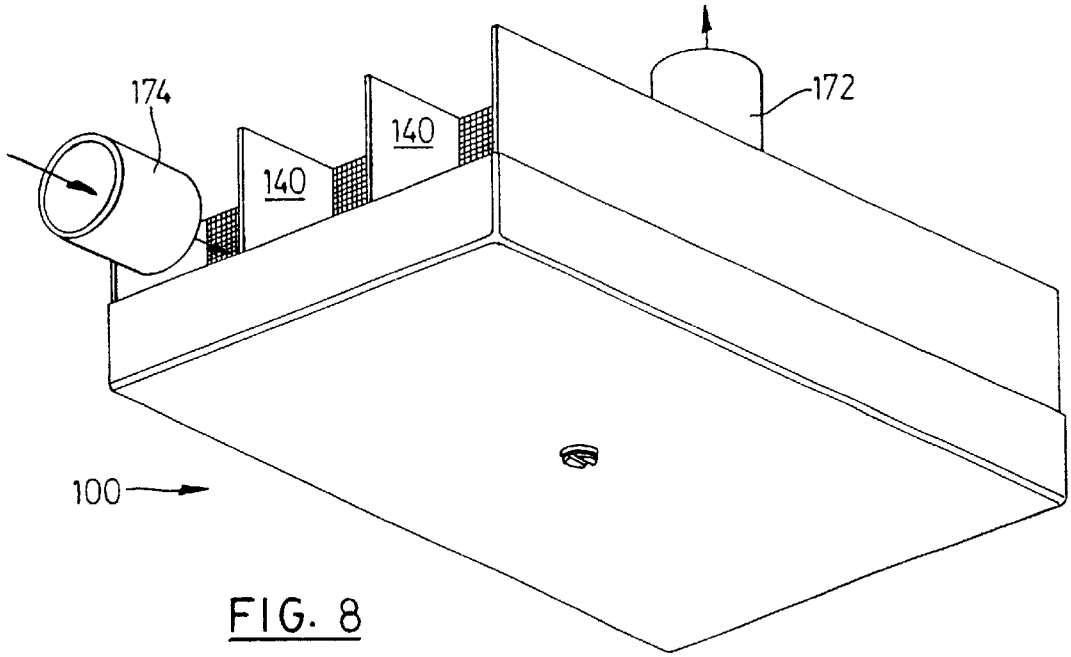
FIG. 8 is a perspective view from below of the catalytic muffler of FIG. 6.
Figure 9:
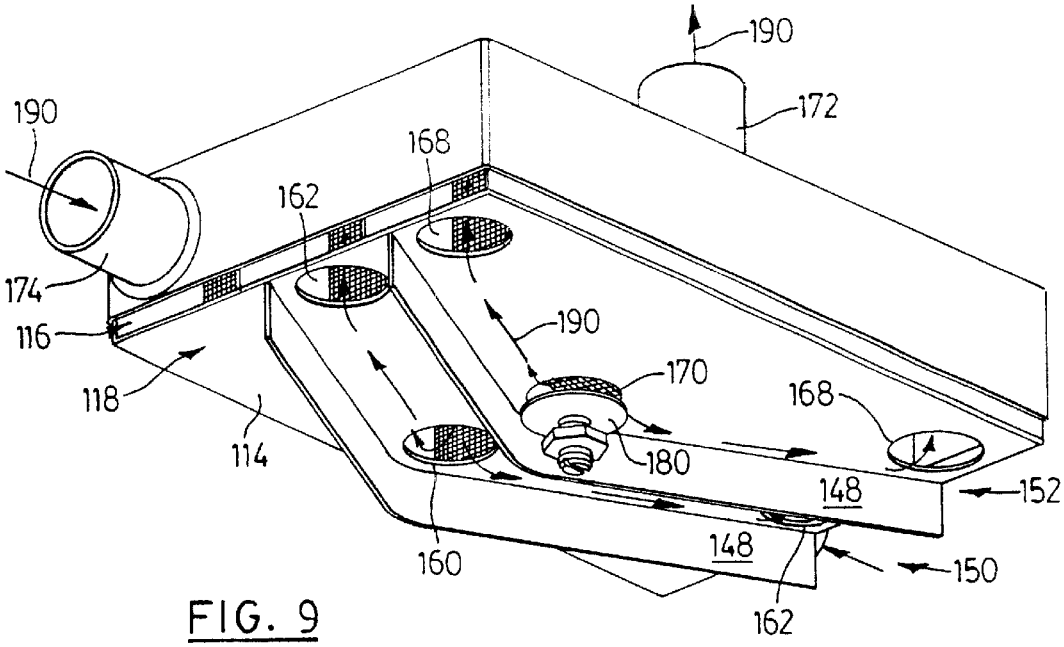
FIG. 9 is a perspective view of a return side of the catalytic muffler of FIG. 6 with a bottom part of its housing removed to show its interior configuration.
Figure 10:
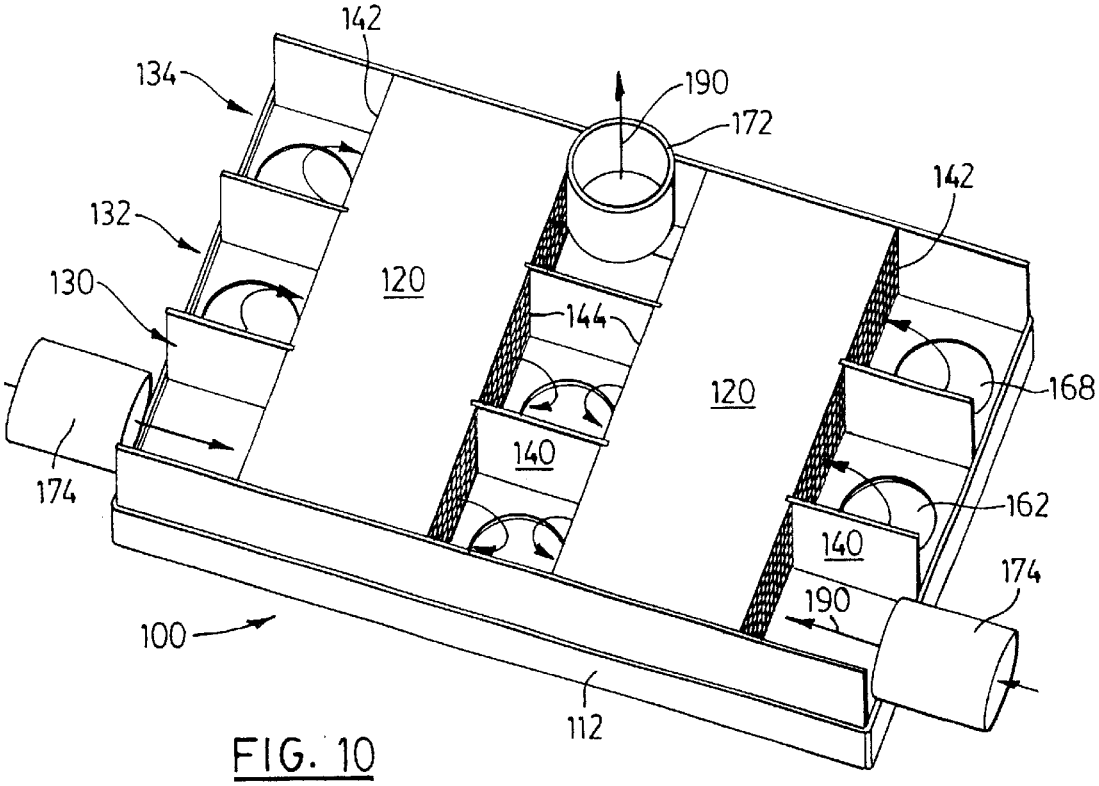
FIG. 10 is a view corresponding to FIG. 7 but taken from the opposite side.
Figure 11:
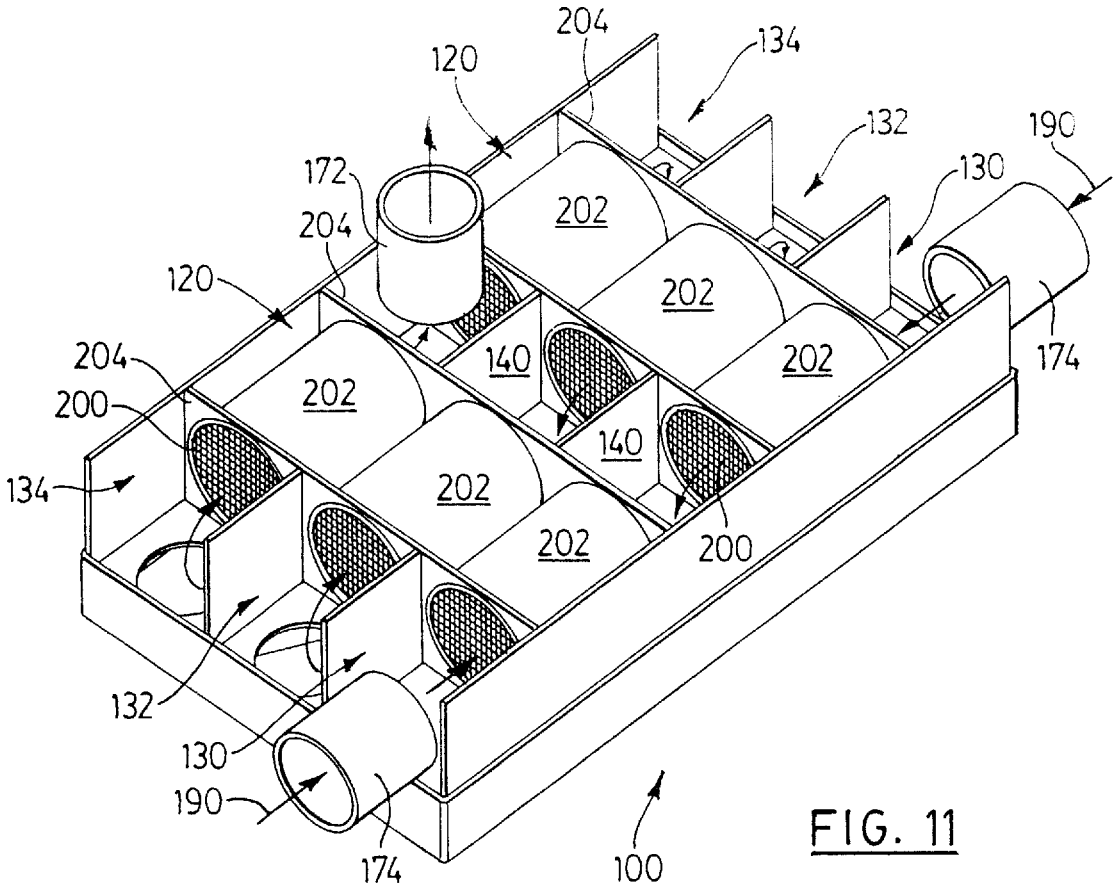
FIG. 11 is a view corresponding to FIG. 7 but illustrating the use of a cylindrical substrate.
Figure 12:
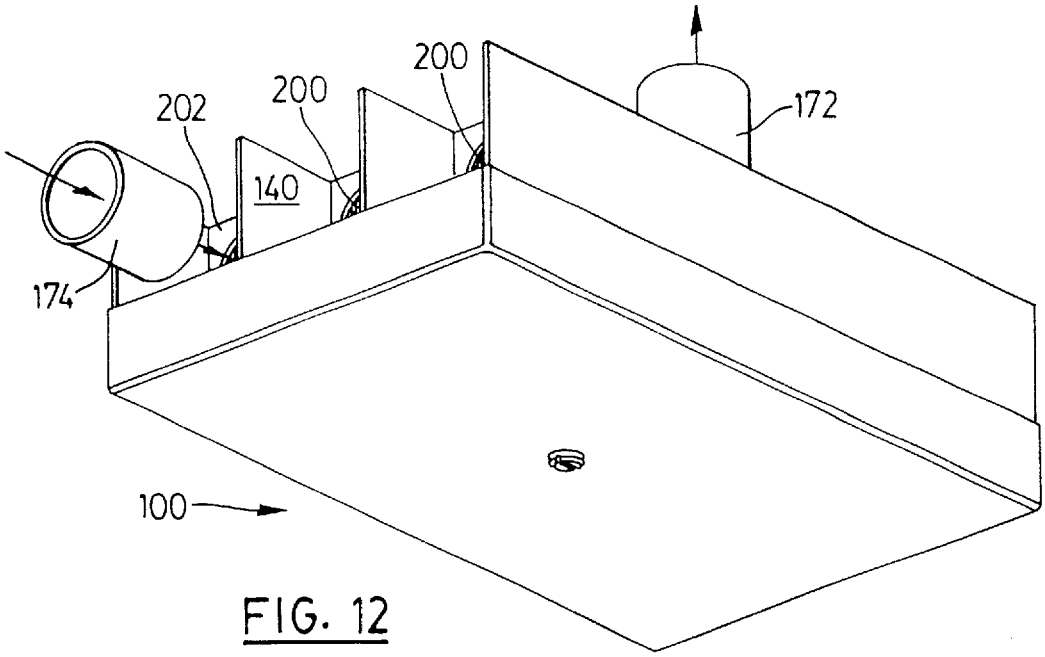
FIG. 12 is a perspective view corresponding to FIG. 8 but illustrating the use of a cylindrical substrate.
Figure 13:
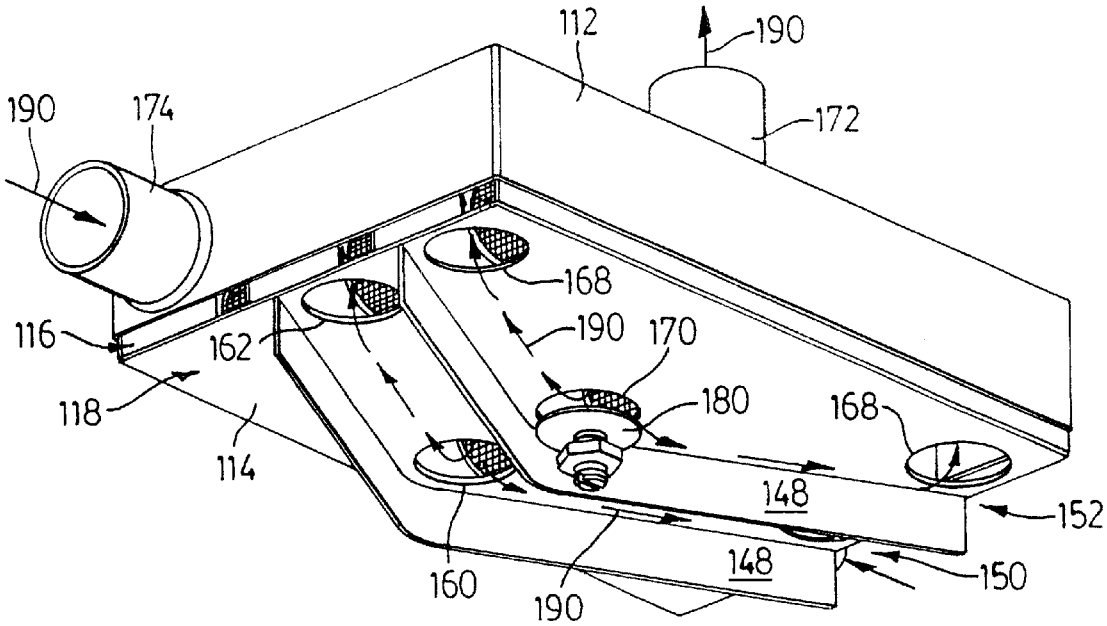
FIG. 13 is a view corresponding to FIG. 9 but illustrating the use of a cylindrical substrate.
Figure 14:
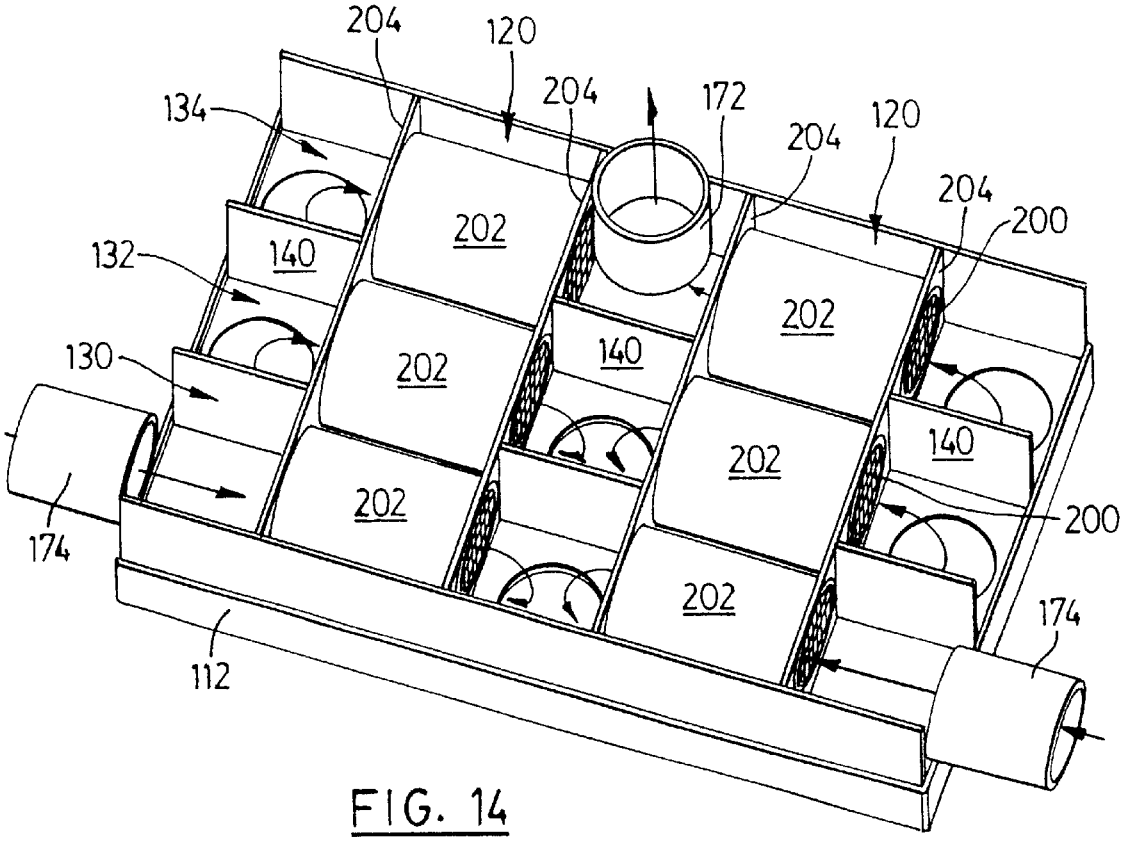
FIG. 14 is a view corresponding to FIG. 11 but taken from the opposite side.

As can be seen in FIG. 4, a flow restrictor 80 may be provided at the aperture 70 to restrict flow through the catalytic muffler. The flow restrictor 80 may be a disc 82 registering with the aperture 70 and movable toward and away from the aperture 70 by an adjusting screw 84 threadedly engaging the housing, a portion of which is represented by a nut 88 in FIGS. 4 and 5. Turning the restrictor 80 will affect flow resistance through the catalytic muffler 10 to vary flow velocity through various parts of the catalytic muffler 10.

As also illustrated in FIG. 4, the baffle members 48 are configured to cause the upstream passage 50 to diverge in the flow direction, illustrated by arrows 90. The baffle members are further configured to provide a generally constant cross-sectional area in the intermediate passage 54 and to cause the downstream passage 52 to converge in the flow direction 90. It will be appreciated that the gas flow will reduce in velocity and pressure along the upstream passage 50, remain at a generally constant velocity and pressure along the intermediate passage 54 and increase in velocity and pressure along the downstream passage.

It is believed that the above arrangement for varying velocity and pressure has a generally beneficial effect on the performance of the catalytic muffler 10. It is also believed that the temperature profile in the reactor bed (or beds 20 and 22 in the preferred embodiment) arising from sequential unidirectional flow through adjacent zones enhances the degree of catalytic conversion.

Although four adjacent flow zones 30, 32, 34 and 36 are described and illustrated, other numbers may be both possible and desirable depending on design parameters for specific applications. In general it is expected that the degree of conversion will be greater with more zones but that this will also increase flow resistance (assuming a given reactor bed size).

An alternate embodiment of the present invention is illustrated in FIGS. 6 through 10. According to the alternate embodiment, a catalytic muffler is generally indicated by reference 100. The catalytic muffler 100 is in essence a doubling up of the catalytic muffler 10 of the previously described embodiment and has two reactor beds 120 spaced apart with respective inlet sides 142 facing away from each other and respective outlet sides 144 facing toward each other.

The catalytic muffler 100 has a housing 112 as in the previously described embodiment which is partitioned by a partition 114 into a reactor side 116 and a return side 118. Wall members 140 extending between the inlet sides 142 of the reactor beds 120, the partition 114 and the housing 112 and between the outlet sides 142 of the reactor beds 120, the housing 112 and the partition 114 define adjacent flow zones 130, 132 and 134 in each reactor bed 120. Flow zone 130 may be considered a "first" flow zone and flow zone 134 a "last" flow zone based on gas flow direction as indicated by arrows 190.

Baffle members 148 extend between the partition 114 and the housing 112 to define upstream and downstream flow passages, 150 and 152 respectively. The upstream flow passage 150 fluidly communicates at its centre with the outlet side 144 of the first zones 130 through the aperture 160 and with the inlet side 142 of adjacent flow zones 132 through apertures 162.

The downstream flow passage 152 fluidly communicates at opposite ends thereof with the inlet sides 142 of the next adjacent flow zones 134 through apertures 168. The downstream flow passage 152 fluidly communicates with the outlet sides 144 of the last flow zones 136 through a central aperture 170.

Respective inlets 174 fluidly communicate with the inlet sides 142 of the first flow zone 130 through the housing 110. An outlet 172 fluidly communicates with the outlet sides 144 of each of the last flow zones 134. Accordingly exhaust flows unidirectionally from the inlets 174 through each reactor bed 120 from the inlet side 142 to the outlet side 144 in sequence from the first flow zone 130 through adjacent flow zones 132 and finally through the last flow zone 134 and out of the outlets 172.

It will be appreciated that although a single reactor bed 120 has been described, it can in turn be made up of a plurality of beds such as a reducing bed 122 and an oxidizing bed 124.

As in the case of the "single inlet/single outlet" design initially described, the alternate embodiment or "single inlet/double outlet" design may have its baffle members 148 configured to vary the cross sectional area of at least the downstream passage 152. Similarly a restrictor 180 may be mounted over one or more of the apertures, such as the apertures 168 or the aperture 170 to adjust the resistance to flow of the catalytic muffler and to balance the flow through each side.

A feature of the double inlet/single outlet design is that it can be configured to operate in a reverse mode, i.e. single inlet/double outlet. If a single reactor bed 120 is used the reconfiguration would merely require connecting the inlets 174 and outlet 172 in reverse. If a plurality of reactor beds, such as reducing beds 122 and oxidizing beds 124 are provided, reversal of the sequence of the beds may be desirable to best take advantage of exhaust temperature and chemistry.

Although test results have not shown any requirement to add further oxygen, such may be desirable in some applications in which case provision might be made such as an excess air inlet port through the housing 12 or 112 or into the inlet 72 or 174.

FIGS. 11 through 14 illustrate a reactor arrangement which is very similar to that illustrated in FIGS. 6 through 10 and accordingly analogous components are identified with similar reference numerals. The principal difference between the FIGS. 6 through 10 embodiment and the FIGS. 11 through 14 embodiment is the use of cylindrical rather than rectangular substrates in the reactor beds 120. Currently some substrate materials, such as metallic ones are not generally available in a rectangular configuration but rather, are only available in a cylindrical configuration. Accordingly, the reactor beds 120 include a housing having tubular passageways 202 arranged in a parallel side-by-side arrangement between generally rectangular end walls 204 from which the wall members 140 extend. Accordingly the reactor bed 120 in this configuration includes a plurality of individual substrates rather than a single substrate partitioned directly by the wall members 140.

A similar arrangement utilizing cylindrical substrate members may be adapted to the single inlet/single outlet variant catalytic muffler 10 illustrated in FIGS. 1 through 5.

The above description is intended in an illustrative rather than a restrictive sense. Variations may be apparent to persons skilled in such apparatus without departing from the spirit and scope of the present invention as defined by the claims set out below.

What is claimed is:

1. A catalytic muffler comprising:

a housing;

at least one reactor bed supported by but not forming part of said housing, each said reactor bed having an array of parallel discrete adjacent flow zones; said flow zones being interconnected by a series of passages for unidirectional flow of a gaseous fluid sequentially through each adjacent flow zone in turn from an inlet side of each said reactor bed to an outlet side of said reactor bed;

an inlet fluidly communicating with a first of each said array of flow zones; and, an outlet fluidly communicating with a last of each said array of flow zones.

2. A catalytic muffler as claimed in claim 1, wherein said reactor bed is made up of an upstream and a downstream part, the upstream part bearing a reducing catalyst and the downstream part bearing an oxidizing catalyst.

3. A catalytic muffler as claimed in claim 2, wherein each said reactor bed includes a plurality of passageways arranged in a parallel side-by-side arrangement between opposite end walls, each said passageway housing at least one substrate member.

4. A catalytic muffler as claimed in claim 1, wherein:

said housing has a partition dividing said housing into a reactor side and a return side;

said reactor bed is housed within said reactor side;

said adjacent zones are defined by wall members extending between said reactor bed, said housing and said partition at said inlet and outlet sides of said bed;

said passages are defined by baffle members in said return side of said housing, said baffle members extending between said partition and said housing; and, said passages fluidly communicate with respective of said flow zones through respected apertures extending through said partition.

5. A catalytic muffler as claimed in claim 4, wherein each said reactor bed includes a plurality of passageways arranged in a parallel side-by-side arrangement between opposite end walls, each said passageway housing at least one substrate member.

6. A catalytic muffler as claimed in claim 4, having:

two of said reactor beds spaced apart with said inlet sides facing;

a single inlet fluidly communicating with both of said first zones; and, a respective outlet fluidly communicating with each of said last zones.

7. A catalytic muffler as claimed in claim 6, wherein each said reactor bed includes a plurality of passageways arranged in a parallel side-by-side arrangement between opposite end walls, each said passageway housing at least one substrate member.

8. A catalytic muffler as claimed in claim 4, having:

two of said reactor beds spaced apart with said outlet sides facing;

a respective inlet fluidly communicating with each said first zone; and, a single outlet fluidly communicating with both of said last zones.

9. A catalytic muffler as claimed in claim 8, wherein each said reactor bed includes a plurality of passageways arranged in a parallel side-by-side arrangement between opposite end walls, each said passageway housing at least one substrate member.

10. A catalytic muffler as claimed in claim 4, wherein:

a first of said passages diverges in said flow direction to reduce exhaust gas velocity as it flows therethrough; and, a last of said passages converges to increase exhaust gas velocity as it flows therethrough.

11. A catalytic muffler as claimed in claim 10 wherein each said reactor bed includes a plurality of passageways arranged in a parallel side-by-side arrangement between opposite end walls, each said passageway housing at least one substrate member.

12. A catalytic muffler as claimed in claim 10, wherein a last of said apertures before said outlet includes an adjust able flow restrictor for varying flow restriction through said catalytic converter.

13. A catalytic muffler as claimed in claim 12, wherein each said reactor bed includes a plurality of passageways arranged in a parallel side-by-side arrangement between opposite end walls, each said passageway housing at least one substrate member.

14. A catalytic muffler as claimed in claim 12, wherein said first passage diverges by an amount corresponding to an amount by which said last passage converges.

15. A catalytic muffler as claimed in claim 14, wherein each said reactor bed includes a plurality of passageways arranged in a parallel side-by-side arrangement between opposite end walls, each said passageway housing at least one substrate member.

16. A catalytic muffler as claimed in claim 14, wherein said reactor bed is made up of an upstream and a downstream part, the upstream part bearing a reducing catalyst and the downstream part bearing an oxidizing catalyst.

17. A catalytic muffler as claimed in claim 16, wherein each said reactor bed includes a plurality of passageways arranged in a parallel side-by-side arrangement between opposite end walls, each said passageway housing at least one substrate member.

* * * * *